US008356782B2

(12) United States Patent
Robichaud et al.

(10) Patent No.: US 8,356,782 B2
(45) Date of Patent: Jan. 22, 2013

(54) HANGING DEVICE

(76) Inventors: Andre Robichaud, Orange, CA (US); Clayton R. Peterson, Laguna Woods, CA (US)

( * ) Notice: Subject to any disclaimer, the term of this patent is extended or adjusted under 35 U.S.C. 154(b) by 0 days.

(21) Appl. No.: 12/620,030

(22) Filed: Nov. 17, 2009

(65) Prior Publication Data

US 2010/0123060 A1 May 20, 2010

Related U.S. Application Data

(60) Provisional application No. 61/199,328, filed on Nov. 17, 2008.

(51) Int. Cl.
*A47G 29/00* (2006.01)
*F16M 13/00* (2006.01)

(52) U.S. Cl. ..... 248/217.1; 248/218.1; 248/497; 248/546

(58) Field of Classification Search ..... 248/497, 248/546, 217.1, 317, 489, 218.2, 218.3, 547, 248/216.1, 217.3, 218.1, 218, 3
See application file for complete search history.

(56) References Cited

U.S. PATENT DOCUMENTS

| | | | | |
|---|---|---|---|---|
| 1,445,372 | A * | 2/1923 | Wagner | 248/217.1 |
| 2,789,783 | A * | 4/1957 | Jones | 248/218.2 |
| 3,312,442 | A | 4/1967 | Moeller | |
| 4,485,995 | A * | 12/1984 | Hogg | 248/218.1 |
| 4,509,713 | A * | 4/1985 | Hogg | 248/546 |
| 4,619,430 | A | 10/1986 | Hogg | |
| 5,028,030 | A | 7/1991 | Lewis | |
| 6,112,344 | A | 9/2000 | Guenther | |
| 6,443,409 | B1 | 9/2002 | Zanzucchi | |
| 6,641,344 | B2 * | 11/2003 | Weiss | 411/450 |
| 6,695,276 | B2 * | 2/2004 | Skorka | 248/497 |
| 7,540,458 | B2 * | 6/2009 | Forbes | 248/303 |
| 2003/0127578 | A1 | 7/2003 | Skorka | |
| 2003/0161703 | A1 | 8/2003 | Weiss | |
| 2004/0159766 | A1 | 8/2004 | Skorka | |
| 2005/0218284 | A1 | 10/2005 | Kurrasch | |
| 2008/0265123 | A1 * | 10/2008 | Repac | 248/546 |
| 2008/0290231 | A1 * | 11/2008 | Repac | 248/217.4 |

FOREIGN PATENT DOCUMENTS

JP 2002098117 A 4/2002

* cited by examiner

*Primary Examiner* — Tan Le
(74) *Attorney, Agent, or Firm* — Beem Patent Law Firm

(57) ABSTRACT

A device is disclosed for supporting an object, such as a picture frame, on a wall. The device includes an arcuate member having a penetration end that terminates in at least one point. The arcuate member further includes a support end, opposite the penetration end, that has a support hook. A pressure disk may be slidably retained at an aperture therethrough on the arcuate member. A plurality of different support accessories may be included, the support hook being adapted to support each support accessory thereon. In use, with the penetration end of the arcuate member contacting the front surface of the wall, pressure is applied to the pressure disk that binds against the arcuate member to force the penetration end of the arcuate member through the wall. The arcuate member is curved such that when the support hook contacts the front surface of the wall the penetration means contacts the rear surface of the wall to retain the device firmly in the wall and to support the object.

20 Claims, 4 Drawing Sheets

HANGING DEVICE

CROSS-REFERENCE TO RELATED APPLICATIONS

This application claims the benefit of U.S. Provisional Patent Application 61/199,328, filed on Nov. 17, 2008, and incorporated herein by reference.

STATEMENT REGARDING FEDERALLY SPONSORED RESEARCH AND DEVELOPMENT

Not Applicable.

FIELD OF THE INVENTION

This invention relates to picture hanging, and more particularly to a device for hanging a picture or a picture frame on drywall material.

DISCUSSION OF RELATED ART

There is often a need to install quickly and easily a hook or hanging device in a wall, such as for hanging a picture frame, a mirror, or the like. Conventional nails and screws require a tool to install, and as such are not always convenient solutions. Thumbtacks or other similar devices, such as that taught in U.S. Pat. No. 6,443,409 to Zanzucchi on Sep. 3, 2002, may be easily installed without tools, but they are typically not very strong and are easily pulled out of the wall surface. Further, drywall, which is the most common form of wall material, is relatively weak. While this allows hanging implements to be relatively easily inserted therein, it also results in only limited holding strength, particularly when a single shaft such as a nail or thumbtack is used.

The prior art is replete with hanging devices that can be installed without tools. One common device, disclosed in U.S. Pat. No. 4,509,713 to Hogg on Aug. 24, 1984, and again in US 2005/0218284 to Kurrasch on Oct. 6, 2005, teaches an arcuate-shaped resilient spring having a wall-penetrating tip on one end and a hook on an opposing end. This type of device, currently sold under the brand name Monkey Hook (www.monkeyhook.com), may be pressed through a wall board, whereby the penetrating tip once through the wall board arcs back up to press against the back side of the wall board. Such a device has the benefit of only leaving a relatively small hole in the wall when the device is removed.

One drawback to this type of device is the difficulty some people have forcing the wire through the wall. A considerable amount of pressure is produced against the hands and fingers during installation of this type of device. Further, excessive twisting of the device to aid in the penetration of the wall may be required, often resulting in additional wall damage. Moreover, such a device, while supporting more weight than a thumbtack, still can only support up to a relatively small weight before causing wallboard failure at the point of penetration.

U.S. Pat. No. 2,789,783 to Jones on Jun. 1, 1953, appears to teach a device similar to the Hogg device, and also with a decorative disk for covering the aperture formed into the wall upon insertion of such a device. Such a disk is fixed on the wire of the device and is not slidable thereon. As such, this disk cannot be used to aid in pushing the penetrating end of the wire through the wall surface. U.S. Pat. No. 6,641,344 to Weiss on Nov. 4, 2003 teaches a device with a similar disk fixedly formed to the wire. U.S. Pat. No. 4,619,430 to Hogg on Oct. 28, 1986, teaches a similar device to Jones.

U.S. Pat. No. 6,695,276 to Skorka on Feb. 24, 2004 shows a support plate 13 moveable with respect to a flat wire member, but the support plate in such a device is used as an additional support for the wire and hook when installed into the wall. This additional support is required because the bend in the flat wire of such a device causes wall board damage as it is inserted and rotated into place, as evidence by gap 34 of FIG. 7 of the Skorka disclosure. Tools are needed to fasten brad nails through the support plate and into the wall.

Therefore, there is a need for a hanging device that allows for relatively quick and easy installation into a wall without tools. Such a needed device would be able to support a heavier load than the prior art devices, and would provide for a pressure disk to facilitate penetration of the device into the wall. Further, such a device would provide for removal of the disk, or hiding thereof from view, once the device is installed. The present invention accomplishes these objectives.

SUMMARY OF THE INVENTION

The present invention is a device for supporting an object, such as a picture frame, on a wall. The device includes an arcuate member having a penetration end that terminates in at least one point. The arcuate member further includes a support end, opposite the penetration end, that has a support means. Preferably the support means is a U-shaped hook.

In one embodiment of the invention, the device includes a pressure disk slidably retained at an aperture therethrough on the arcuate member between the penetration end and the support end. A first stop means is included along the arcuate member proximate the penetration end for retaining the pressure disk on the arcuate member.

The first stop means, in one embodiment, is just the binding friction caused between the aperture in the pressure disk and the arcuate member when pressure is applied to one side of the pressure disk. As such, the arcuate member passes through the aperture with a close tolerance. Serrations may additionally be included along the length of the arcuate member to increase the binding friction of the first stop means. Alternately, or additionally, the first stop means may further include a protrusion formed proximate the penetration end of the arcuate member. The protrusion extends away from the arcuate member sufficiently to stop the pressure disk from sliding past the protrusion.

The arcuate member may be circular in cross-section, wherein the aperture in the pressure disk is also circular and adapted to receive the arcuate member therethrough. In such an embodiment the pressure disk is rotatable on the arcuate member. Alternately, the arcuate member may be non-circular in cross-section, such as rectangular, oval, square, D-shape, or the like. As such, the aperture in the pressure disk is a cooperative non-circular shape and is adapted to receive the arcuate member therethrough, the pressure disk being rotationally fixed with respect to the arcuate member.

The support means may alternately take the form of a rigid hook fixedly molded around, or otherwise attached to, the support end of the arcuate member. Such a rigid hook preferably includes a wall-contacting surface and, optionally, a pressure disk depression that is recessed from the wall-contacting surface by at least the width of the pressure disk, such that the pressure disk may be fully contained, out of sight, within the disk depression when the rigid hook is installed fully against the wall.

A plurality of different support accessories may be included, the rigid hook being adapted to support each support accessory thereon. Such support accessories may each snap onto, magnetically attach, or otherwise cooperate with the rigid hook to be selectively yet firmly held thereby on the wall. Support accessories may include, for example, any of the following: various sized picture hanging hooks, double hooks, key ring holders, towel holders, coat hangers, or similar types of hook or hanging-type devices.

Additionally, the support means may include a wall-penetrating pin for penetrating the wall, thereby maintaining the rotational orientation of the support means with respect to the wall when fully installed therein. Further, a second stop means may be fixed to the arcuate member for allowing the arcuate member to pass through the wall in one direction but not in the reverse direction. Such a second stop means may be a protrusion stamped out of the arcuate member proximate the support end, for example. A non-linear wall engagement section may be further included proximate the support end of the arcuate member, such that when fully inserted into the wall the device is retained therein by friction of the wall engagement section with the wall. Such a wall engagement section may take the form of a more-pronounced arc in the arcuate member, serrations, a thicker portion of the arcuate member, or the like.

In use, with the pressure disk engaging the first stop means and the penetration end of the arcuate member contacting the front surface of the wall, pressure is applied to the pressure disk to force the penetration end of the arcuate member through the wall. The pressure disk is easier for the typical user to press against than the relatively thin arcuate member, making installation easier than prior art devices. The arcuate member is thereby inserted fully through the wall. The arcuate member is curved such that when the support means contacts the front surface of the wall the penetration means contacts the rear surface of the wall to retain the device firmly in the wall and to support the object. The arcuate member, being somewhat resilient, flexes, resulting in an internal tension in the arcuate member that keeps the device in place once installed.

The present device is a hanging device that allows for relatively quick and easy installation into a wall without tools. The present invention is able to support a heavier load than the prior art devices, and provides for a pressure disk to facilitate penetration of the device into the wall. Further, the present device provides for removal of the disk, or hiding thereof from view, once the device is installed. Other features and advantages of the present invention will become apparent from the following more detailed description, taken in conjunction with the accompanying drawings, which illustrate, by way of example, the principles of the invention.

DETAILED DESCRIPTION OF THE PREFERRED EMBODIMENT

Illustrative embodiments of the invention are described below. The following explanation provides specific details for a thorough understanding of and enabling description for these embodiments. One skilled in the art will understand that the invention may be practiced without such details. In other instances, well-known structures and functions have not been shown or described in detail to avoid unnecessarily obscuring the description of the embodiments.

Unless the context clearly requires otherwise, throughout the description and the claims, the words "comprise," "comprising," and the like are to be construed in an inclusive sense as opposed to an exclusive or exhaustive sense; that is to say, in the sense of "including, but not limited to." Words using the singular or plural number also include the plural or singular number respectively. Additionally, the words "herein," "above," "below" and words of similar import, when used in this application, shall refer to this application as a whole and not to any particular portions of this application. When the claims use the word "or" in reference to a list of two or more items, that word covers all of the following interpretations of the word: any of the items in the list, all of the items in the list and any combination of the items in the list. Any use of the word "means" herein is intended to invoke means-plus-function limitation in accordance with 35 U.S.C. §112, sixth paragraph, even if the word "means" follows words describing the function.

Figure 1:
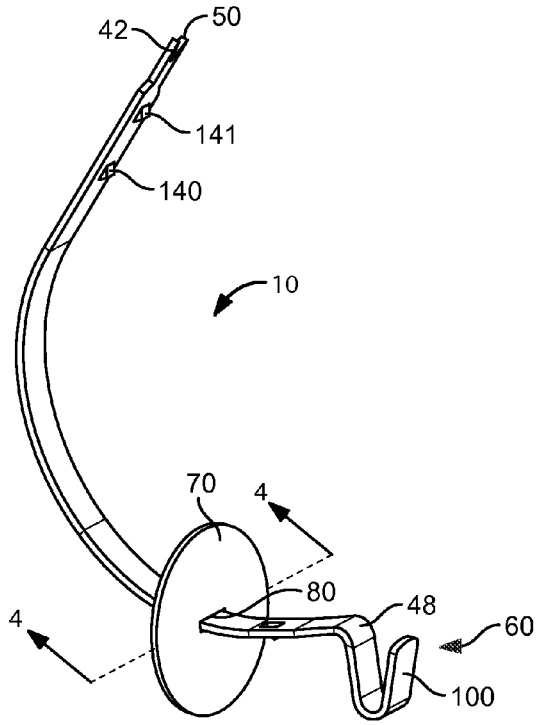
FIG. 1 is a perspective view of one embodiment of the invention.
Figure 2:
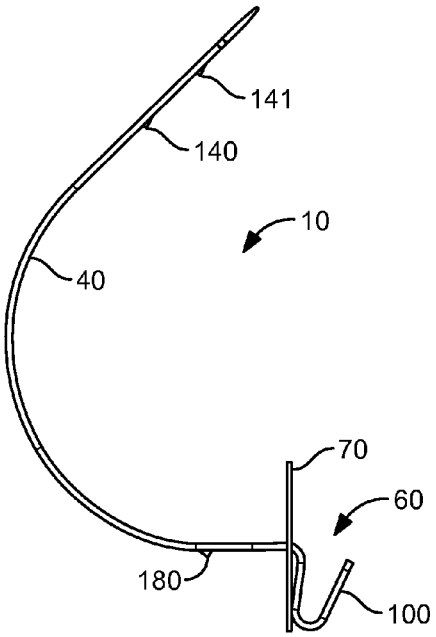
FIG. 2 is a side elevational view thereof.
Figure 3:
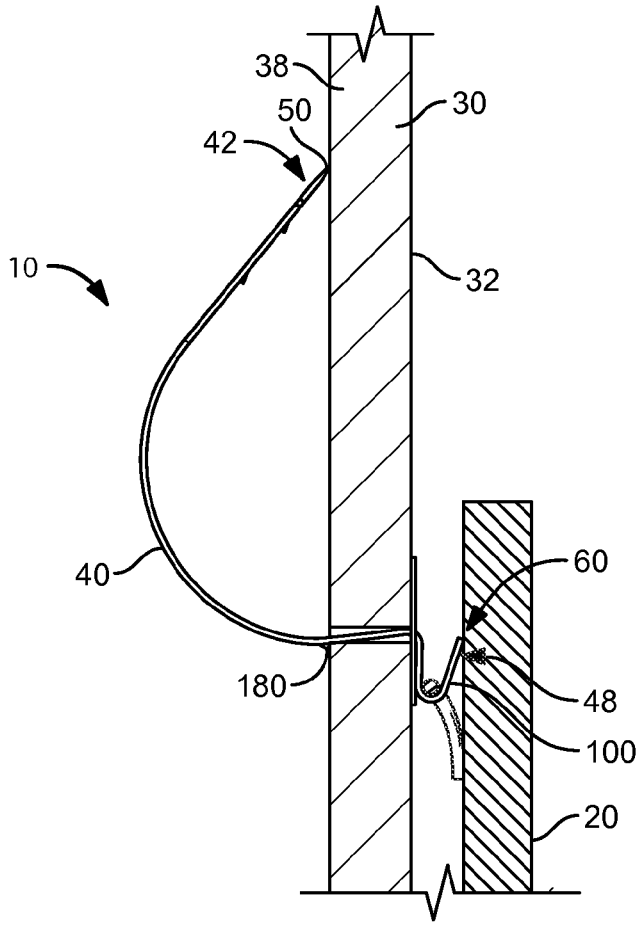
FIG. 3 is a cross-sectional view of the invention, illustrated as fully installed in a wall.

FIGS. 1-3 illustrate a device 10 for support an object 20 on a wall 30, the wall 30 having a front surface 32 and a rear surface 38. The wall 30 may be standard wallboard, drywall, gypsum, plaster, or the like. The object 20 may be a picture frame, mirror, or other object 20 as determined by a user of the device 10.

Figure 6A:
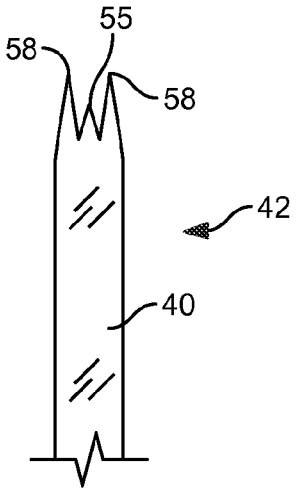
FIG. 6A is an enlarged view of one embodiment of a penetration end of an arcuate member of the invention.
Figure 6B:
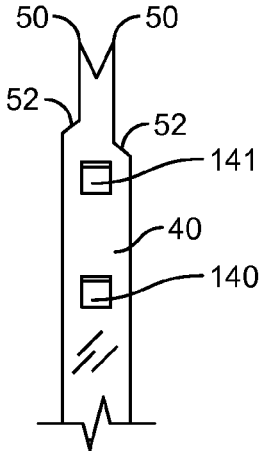
FIG. 6B is an enlarged view of an alternate embodiment of the penetration end of the arcuate member of the invention.
Figure 6C:
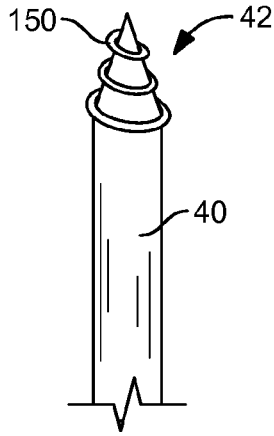
FIG. 6C is an enlarged view of yet another alternate embodiment of the penetration end of the arcuate member of the invention.

The device 10 includes an arcuate member 40 having a penetration end 42 that terminates in at least one point 50. In one embodiment, the penetration end terminates in two points 50 (FIG. 6B). In an alternate embodiment, the penetration end 42 terminates in two points 58 and a relatively shorter center point 55 (FIG. 6A), the combination of points 58, 55 serving to efficiently pierce drywall paper (not shown), or the like. At least one width-reducing step 52 (FIG. 6B) may also be included proximate the penetration end 42 for facilitating the piercing of drywall materials incrementally as the penetration end 42 is forced through the wall 30. For example, two 1/16" steps that incrementally increase the width of the penetration end 42 from 1/8" to 3/16" and then from 3/16" to 1/4", may be included. Preferably the penetration end 42 includes two such steps 52, staggered with respect to their lateral position along the length of the arcuate member 40, each 1/16" of an inch in width, but clearly other dimensions and numbers of steps 52 may be used. Alternately, or additionally, the penetration end 42 may include a corkscrew cutting blade 150 (FIG. 6C) for boring through the wall 30 when the arcuate member 40 is pressed against the front surface 32 of the wall 30 and rotated. Other cutting configurations may be included at the penetration end 42 without departing from the spirit and scope of the present invention.

The arcuate member 40 further includes a support end 48, opposite the penetration end 42, that has a support means 60. Preferably the support means 60 is a U-shaped hook 100 (FIGS. 1-3). Clearly the support means 60 may also be formed into a V-shaped or J-shaped hook (not shown), or other hook shape as may be desired.

In one embodiment of the invention, the device 10 includes a pressure disk 70 slidably retained at an aperture 80 therethrough on the arcuate member 40 between the penetration end 42 and the support end 48. A first stop means 90 is included along the arcuate member 40 proximate the penetration end 42 for retaining the pressure disk 70 on the arcuate member 70. In one embodiment, the support end 48 of the arcuate member 40 is engageable with the pressure disk 70 to form the support means 60 (not shown). As such, the pressure disk 70 may include the U-shaped hook 100, the pressure disk 70 being prevented from disengaging the arcuate member 40 at the support end 48 thereof. The pressure disk 70 may be circular in plan view, as illustrated, but may also take any other suitable shape as desired, such as square, rectangular, oval, or the like. The pressure disk 70 is preferably stamped out of a metal sheet material, but may also be molded from a rigid and strong plastic material, epoxy resin material, or the like.

Figure 4A:
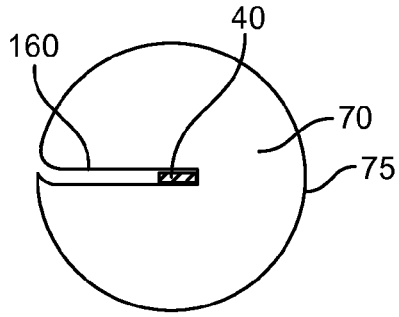
FIG. 4A is a cross-sectional view of one embodiment of a pressure disk, taken generally along lines 4-4 of FIG. 1.

The support means 60 may be formed to allow the pressure disk 70 to be removed from the support end 50 of the arcuate member 40, or not, as desired. For example, a V-shaped hook as the support means 60 prevents the pressure disk 70 from being removed from the device 10. Alternately, the U-shaped hook 110 may be formed to allow the pressure disk 70 to slide off of the support end 48 of the arcuate member 40. Alternately, the aperture 80 of the pressure disk 70 is a J-shaped slot 160 open at one edge 75 of the pressure disk 70, which allows the pressure disk 70 to be selectively removed from the arcuate member 40 laterally (FIG. 4A).

Figure 5A:
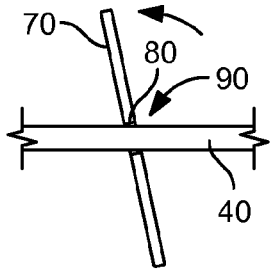
FIG. 5A is a cross-sectional view of one embodiment of a first stop means of the invention.
Figure 5B:
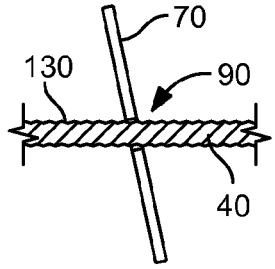
FIG. 5B is a cross-sectional view of an alternate embodiment of a first stop means of the invention.

The first stop means 90, in one embodiment, is the binding friction caused between the aperture 80 in the pressure disk 70 and the arcuate member 40 when pressure is applied to one side of the pressure disk 70 (FIG. 5A). As such, the arcuate member 40 passes through the aperture 80 with a close tolerance, such as a few less than 0.010 of an inch, for example. Serrations 130 (FIG. 5B) may additionally be included along the length of the arcuate member 40 to increase the binding friction of the first stop means 90. Alternately, or additionally, the first stop means 90 may further include a first protrusion 140 (FIGS. 1 and 2) formed proximate the penetration end 42 of the arcuate member 40. The first protrusion 140 extends away from the arcuate member 40 sufficiently to stop the pressure disk 70 from sliding past the first protrusion 140, as the first protrusion height plus the width of the arcuate member 40 exceeds the width of the aperture 80 in the arcuate member 40. Preferably the first protrusion 140 is ramped so that the pressure disk 70 may be installed onto the arcuate member 40 at the penetration end 42 during manufacturing. A second protrusion 141 may be further included for creating a trough through the wall 30 as a guide or track for the first protrusion 140 therethrough.

Figure 4B:
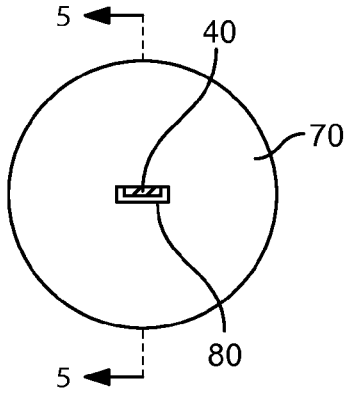
FIG. 4B is a cross-sectional view of an alternate embodiment of the pressure disk, taken generally along lines 4-4 of FIG. 1.

The arcuate member 40 may be circular in cross-section, wherein the aperture 80 in the pressure disk 70 is also circular (not shown) and adapted to receive the arcuate member 40 therethrough. In such an embodiment the pressure disk 70 is rotatable on the arcuate member 40. Alternately, the arcuate member 40 may be non-circular in cross-section, such as rectangular (FIGS. 4A and 4B), oval (not shown), square (not shown), D-shape (not shown), or the like. As such, the aperture 80 in the pressure disk 70 is a cooperative non-circular shape and is adapted to receive the arcuate member 40 therethrough, the pressure disk 70 being rotationally fixed with respect to the arcuate member 40. The arcuate member 40 is preferably made of spring steel, but can also be made of any other suitably strong, resilient materials, such as aluminum, zinc, hydrocarbon polymers, or the like. For example, a rectangular shaped spring steel wire arcuate member 40 having cross-sectional dimensions of approximately 0.0625"×0.25" can hold up to 165 lbs. in a standard 5/8" drywall wall 30. Larger gauge wire may be used for heavier load requirements. Such an arcuate member 40 may be formed by stamping from a sheet steel material, for example, and then bent into the arcuate shape illustrated in FIG. 2.

Figure 7A:
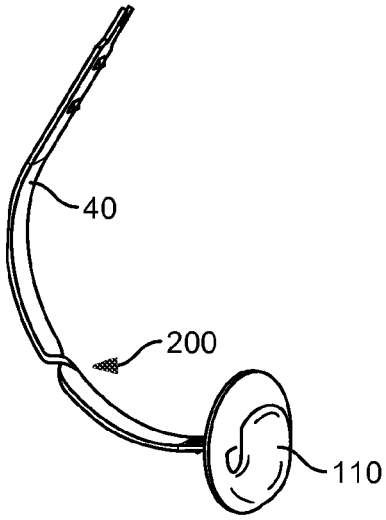
FIG. 7A is a perspective view of an alternate embodiment of the invention.
Figure 7B:
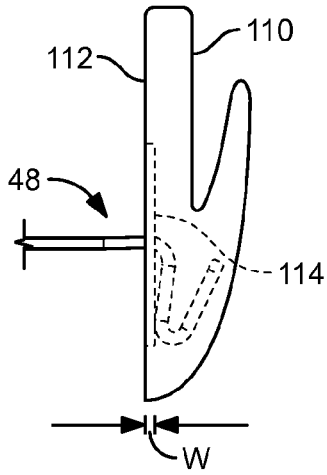
FIG. 7B is a partial side elevational view of the embodiment of FIG. 7A.

The support means 60 may alternately take the form of a rigid hook 110 (FIGS. 7A, 7B, 8A, and 8B) fixedly molded around, or otherwise attached to, the support end 48 of the arcuate member 40. Such a rigid hook 110 preferably includes a wall-contacting surface 112 and, optionally, a pressure disk depression 114 (FIG. 7B) that is recessed from the wall-contacting surface 112 by at least the width W of the pressure disk 70, such that the pressure disk 70 may be fully contained, out of sight, within the disk depression 114 when the rigid hook 110 is installed fully against the wall 30. The pressure disk depression 114 may conform to the shape of the pressure disk 70, or, alternately, the wall-contacting surface 112 is formed on a peripheral lip (not shown) of the rigid hook 110, the pressure disk depression 114 taking the form of the rigid hook 110 less the peripheral wall-contacting surface 112.

Figure 8A:
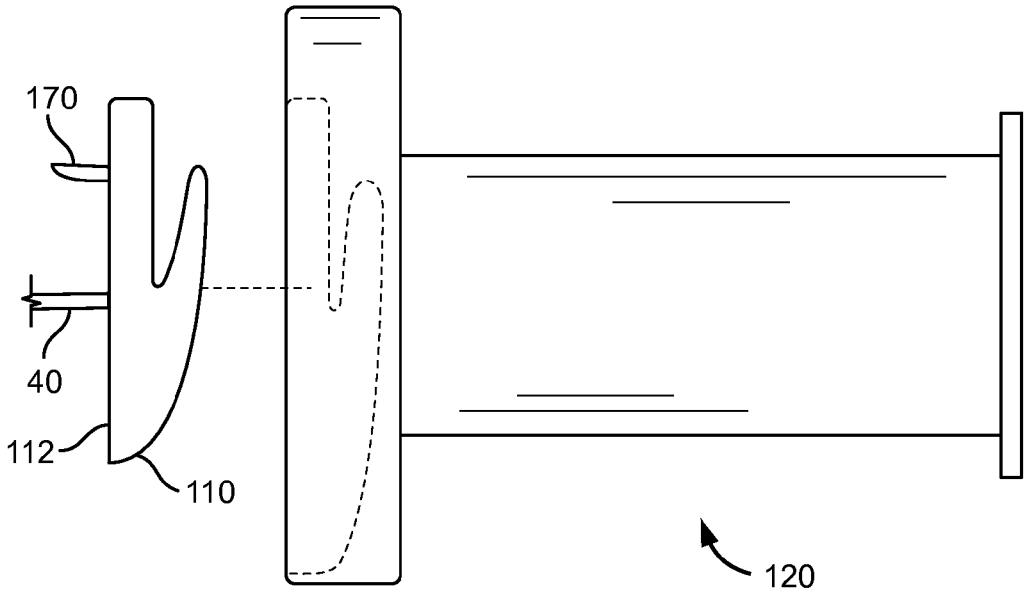
FIG. 8A is an exploded side elevational view of a support accessory for use in conjunction with a rigid hook of the invention.
Figure 8B:
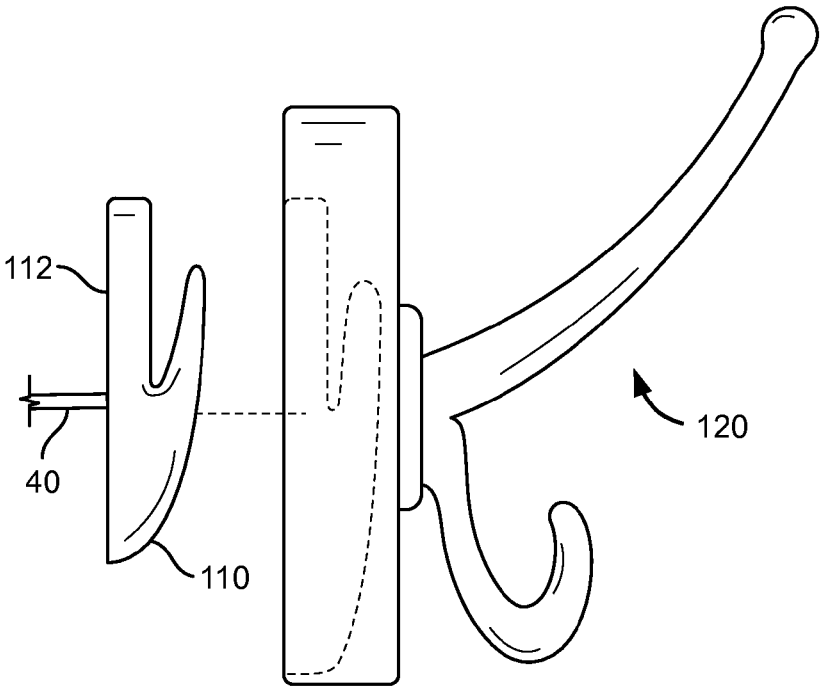
FIG. 8B is an exploded side elevational view of an alternate support accessory.

A plurality of different support accessories 120 may be included, the rigid hook 110 being adapted to support each support accessory 120 thereon (FIGS. 8A and 8B). Such support accessories 120 may each snap onto, magnetically attach, or otherwise cooperate with the rigid hook 110 to be selectively yet firmly held thereby on the wall 30. Examples of support accessories 120 may include, for example, any of the following: various sized picture hanging hooks, double hooks, key ring holders, towel holders, coat hangers, or similar types of hook or hanging-type devices.

Figure 9:
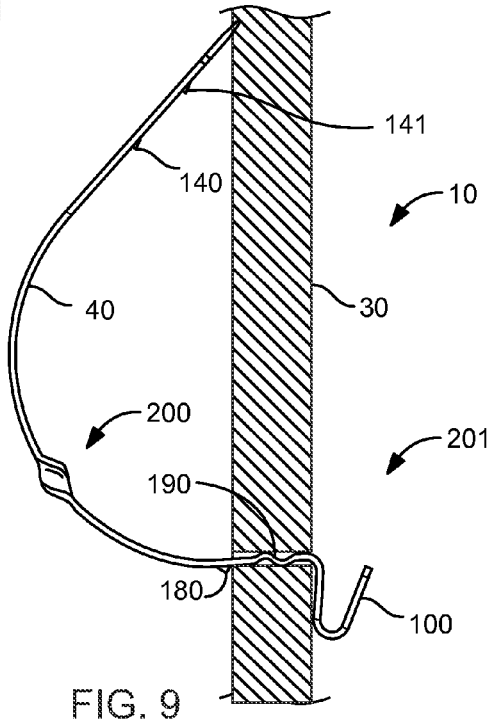
FIG. 9 is a side elevational view of an alternate embodiment of the arcuate member of the invention.

Additionally, the support means 60 may include a wall-penetrating pin 170 (FIG. 8A) for penetrating the wall 30, thereby maintaining the rotational orientation of the support means 60 with respect to the wall 30 when fully installed therein. Further, a second stop means 180 (FIG. 2) may be fixed to the arcuate member 40 for allowing the arcuate member 40 to pass through the wall 30 in one direction but not in the reverse direction. Such a second stop means 180 may be a protrusion stamped out of the arcuate member 40 proximate the support end 48. A non-linear wall engagement section 190 (FIG. 9) may be further included proximate the support end 48 of the arcuate member 40, such that when fully inserted into the wall 30 the device 10 is retained therein by friction of the wall engagement section 190 with the wall 30. Such a wall engagement section 190 may take the form of a more-pronounced arc in the arcuate member 40, serrations (not shown), a thicker portion of the arcuate member (not shown), or the like.

In use, with the pressure disk 70 engaging the first stop means 90 and the penetration end 42 of the arcuate member 40 contacting the front surface 32 of the wall 30, pressure is applied to the pressure disk 70 to force the penetration end 42 of the arcuate member 40 through the wall 30. The pressure disk 70 is easier for the typical user to press against than the relatively thin arcuate member 40, making installation easier than prior art devices. The arcuate member 40 is thereby inserted fully through the wall. The arcuate member 40 is curved such that when the support means 60 contacts the front surface 32 of the wall 30 the penetration means 42 contacts the rear surface 38 of the wall 30 to retain the device 10 firmly in the wall 30 and to support the object 20. The arcuate member 40, being somewhat resilient, flexes, resulting in an internal tension in the arcuate member 40 that keeps the device 10 in place once installed. The amount of tension in the arcuate member 40 depends in some part on the thickness of the wall 30, and different sized arcuate members 40, or arcuate members 40 having differently-shaped arcs, may be made to accommodate different thicknesses of the wall 30, such as ¼", ½", ⅝", ¾", or the like.

In an alternate embodiment of the invention, wherein the arcuate member 40 is non-circular in cross-section, and that either includes or does not include the pressure disk 70 as desired, the arcuate member 40 further includes a spiral section 200 (FIGS. 7A and 9) between the support end 48 and the penetration end 42 thereof. As such, when the arcuate member 40 is being forced through the wall 30, the arcuate member 40 rotates preferably about 180 degrees as the spiral section 200 passes through the wall 30. In such an embodiment, the arcuate member 40 is first positioned with the penetration end 42 against the front surface 32 of the wall 30 and oriented with the support means 60 inverted with respect to a final desired support means position 201. After the arcuate member 40 is pushed fully through the wall 30, the support means 60 is positioned upright as desired. Such an embodiment is relatively easy to push through the wall 30 by grasping the majority of the arcuate member 40 with all fingers of a human hand (not shown), for example, and pressing the penetration end 42 of the arcuate member 40 into the wall 30 with the thumb. The spiral section 200 may be lengthened as desired into a longer spiral section 200 to minimize wall damage 30 with softer or thicker wall materials.

While a particular form of the invention has been illustrated and described, it will be apparent that various modifications can be made without departing from the spirit and scope of the invention. For example, the arcuate member 40 is illustrated as rectangular in cross-section, but any other suitable shape may also be effective. Accordingly, it is not intended that the invention be limited, except as by the appended claims.

Particular terminology used when describing certain features or aspects of the invention should not be taken to imply that the terminology is being redefined herein to be restricted to any specific characteristics, features, or aspects of the invention with which that terminology is associated. In general, the terms used in the following claims should not be construed to limit the invention to the specific embodiments disclosed in the specification, unless the above Detailed Description section explicitly defines such terms. Accordingly, the actual scope of the invention encompasses not only the disclosed embodiments, but also all equivalent ways of practicing or implementing the invention.

The above detailed description of the embodiments of the invention is not intended to be exhaustive or to limit the invention to the precise form disclosed above or to the particular field of usage mentioned in this disclosure. While specific embodiments of, and examples for, the invention are described above for illustrative purposes, various equivalent modifications are possible within the scope of the invention, as those skilled in the relevant art will recognize. Also, the teachings of the invention provided herein can be applied to other systems, not necessarily the system described above. The elements and acts of the various embodiments described above can be combined to provide further embodiments.

All of the above patents and applications and other references, including any that may be listed in accompanying filing papers, are incorporated herein by reference. Aspects of the invention can be modified, if necessary, to employ the systems, functions, and concepts of the various references described above to provide yet further embodiments of the invention.

Changes can be made to the invention in light of the above "Detailed Description." While the above description details certain embodiments of the invention and describes the best mode contemplated, no matter how detailed the above appears in text, the invention can be practiced in many ways. Therefore, implementation details may vary considerably while still being encompassed by the invention disclosed herein. As noted above, particular terminology used when describing certain features or aspects of the invention should not be taken to imply that the terminology is being redefined herein to be restricted to any specific characteristics, features, or aspects of the invention with which that terminology is associated.

In general, the terms used in the following claims should not be construed to limit the invention to the specific embodiments disclosed in the specification, unless the above Detailed Description section explicitly defines such terms. Accordingly, the actual scope of the invention encompasses not only the disclosed embodiments, but also all equivalent ways of practicing or implementing the invention under the claims.

While certain aspects of the invention are presented below in certain claim forms, the inventor contemplates the various aspects of the invention in any number of claim forms. Accordingly, the inventor reserves the right to add additional claims after filing the application to pursue such additional claim forms for other aspects of the invention.

What is claimed is:

1. A device for supporting an object on a wall having front and rear surfaces, the device comprising:

an elongated arcuate member having a penetration end and a support end, the penetration end terminating in at least one point, the support end having a support means; and a pressure disk slidably retained at an aperture therethrough on the arcuate member between the penetration end and the support end thereof, a first stop means including a first protrusion, the first stop means being included along the arcuate member proximate the penetration end for retaining the pressure disk on the arcuate member, the first protrusion extending away from a surface of the arcuate member sufficiently to stop the pressure disk from sliding past the protrusion, the first stop means for applying a resistive force to the pressure disk in a direction opposite the direction of the pointed penetration end of the arcuate member;

whereby with the pressure disk engaging the first stop means and the penetration end of the arcuate member contacting the front surface of the wall, pressure may be applied to the pressure disk to force the penetration end of the arcuate member through the wall, whereupon the arcuate member may be fully inserted through the wall, the arcuate member curved such that when the support means or the pressure disk contacts the front surface of the wall the penetration means contacts the rear surface of the wall to retain the device firmly in the wall.

2. The device of claim 1 wherein the penetration end terminates in two points.

3. The device of claim 1 wherein the penetration end terminates in three points, a center point thereof being relatively shorter than the other two points.

4. The device of claim 1 wherein the support means is a U-shaped hook formed into the support end of the arcuate member.

5. The device of claim 1 wherein the support means is a rigid hook fixedly formed around the support end of the arcuate member.

6. The device of claim 5 wherein the rigid hook includes a wall-contacting surface and a pressure disk depression recessed from the wall-contacting surface by at least the width of the pressure disk.

7. The device of claim 5 wherein the rigid hook is adapted to cooperate with any of a plurality of support accessories to fixedly retain such a support accessory thereon when engaged therewith and when the rigid hook contacts the wall surface and the device is fully engaged with the wall.

8. The device of claim 1 wherein the arcuate member is circular in cross-section and wherein the aperture in the pressure disk is circular and adapted to receive the arcuate member therethrough, the pressure disk rotatable on the arcuate member.

9. The device of claim 1 wherein the arcuate member is non-circular in cross-section and wherein the aperture in the pressure disk is of a cooperating non-circular shape adapted to receive the arcuate member therethrough, the pressure disk rotationally fixed with respect to the arcuate member.

10. The device of claim 1 wherein the first stop means further includes a binding friction between the aperture in the pressure disk and the arcuate member when pressure is applied to one side of the pressure disk.

11. The device of claim 10 wherein the arcuate member includes serrations along its length to increase the friction of the first stop means.

12. The device of claim 1, further including a second protrusion formed between the first stop means and the penetration end of the arcuate member, the second protrusion adapted to form a guiding track through the wall for the protrusion.

13. The device of claim 1 wherein the support end of the arcuate member is adapted to allow the pressure disk to be slidably removed therefrom.

14. The device of claim 1 wherein the penetration end includes a corkscrew cutting blade for boring through the wall when the arcuate member is pressed against the front surface of the wall and rotated.

15. The device of claim 1 wherein the aperture of the pressure disk is a J-shaped aperture open at one edge of the pressure disk, such that the pressure disk may be selectively engaged or disengaged laterally from the arcuate member.

16. The device of claim 1 wherein the support end of the arcuate member is engageable with the pressure disk to form the support means.

17. The device of claim 1 wherein the support means includes a wall-penetrating pin for penetrating the wall board to maintain the rotational orientation of the support means with respect to the wall.

18. The device of claim 1 further including a second stop means fixed to the arcuate member, the second stop means allowing the arcuate member to pass through the wall in one direction but not in the reverse direction.

19. The device of claim 1 wherein the arcuate member further includes a non-linear wall engagement section proximate the support end, such that when fully inserted into the wall the device is retained therein by friction of the wall engagement section with the wall.

20. The device of claim 1 wherein the penetration end further includes at least two lateral steps, each lateral step staggered with respect to their lateral position along the length of the arcuate member, for facilitating penetration of the penetration end of the arcuate member through the wall.

* * * * *